US005296904A

United States Patent [19]

Jackson

[11] Patent Number: 5,296,904

[45] Date of Patent: Mar. 22, 1994

[54] THREE-ROLL FUSER WITH CENTER PRESSURE ROLL FOR BLACK AND COLOR APPLICATION

[75] Inventor: Mark S. Jackson, Rochester, N.Y.

[73] Assignee: Xerox Corporation, Stamford, Conn.

[21] Appl. No.: 41,308

[22] Filed: Mar. 31, 1993

[51] Int. Cl.[5] ..... G03G 15/20

[52] U.S. Cl. ..... 355/290; 219/216; 432/60; 355/285

[58] Field of Search ..... 355/285, 282, 289, 290; 219/216, 388; 432/60

[56] References Cited

U.S. PATENT DOCUMENTS

| | | | |
|---|---|---|---|
| 3,965,331 | 6/1976 | Moser et al. | 219/216 |
| 4,147,501 | 4/1979 | Goshima et al. | 432/60 |
| 4,444,486 | 4/1984 | Monkelbaan | 219/216 |
| 4,716,435 | 12/1987 | Wilson . | |
| 4,791,447 | 12/1988 | Jacobs . | |
| 4,928,148 | 5/1990 | Higashi . | |
| 4,967,237 | 10/1990 | Sasaki et al. . | |
| 5,019,869 | 5/1991 | Patton . | |
| 5,053,828 | 10/1991 | Ndebi et al. . | |
| 5,084,731 | 1/1992 | Baruch . | |

*Primary Examiner*—R. L. Moses

*Attorney, Agent, or Firm*—Oliff & Berridge

[57] ABSTRACT

A three roll fuser system for a xerographic machine includes a reversibly drivable central pressure roll, a first fuser roll located adjacent the central pressure roll forming a first fuser nip with the central roll, and a second fuser roll located adjacent the central pressure roll on a substantially opposite side of the central pressure roll as the first fuser roll forming a second fuser nip with the central roll. Copy sheets having an unfused image on a side thereof are transported from an inlet through one of the first and second nips to fuse the image on the copy sheet and then transported to an outlet. The three roll fuser system is capable of selectively fusing either side of a copy sheet without requiring extra sheet inverting devices. In a preferred embodiment, the fuser rolls have differing physical properties and can be operated under different operating conditions such as fuser temperature and speed.

28 Claims, 3 Drawing Sheets

THREE-ROLL FUSER WITH CENTER PRESSURE ROLL FOR BLACK AND COLOR APPLICATION

BACKGROUND OF THE INVENTION

1. Field of the Invention

The present invention relates to a xerographic fuser architecture which provides two separate fuser rolls about a central common pressure roll, each fuser roll being designed for a different application, i.e., color fusing or black and white fusing requirements.

2. Description of Related Art

Most known fuser roll architectures utilize a single fuser roll in conjunction with a pressure roll. If used for a single application, such as black and white printing, the fuser roll design can accommodate the needs of the particular printing that is to be done. For example, typically customer preference for color xerographic prints is a high gloss finish. This usually requires the use of a smooth, conformable fuser roll operating at a high temperature and having a long-dwell nip. However, customer preference for black and white xerographic copies is a matte finish, which requires a different fuser design and operating parameters. In a color copier which can provide either color or black and white xerographic prints, it has been customary to compromise the needs of these different operating parameters and design criteria into a design which can adequately provide moderate capabilities of either type print.

There are known fusing systems which provide multiple fusers such as U.S. Pat. Nos. 4,928,148; 5,019,869; 4,791,447; and 5,053,828.

There is a need for a multiple fuser system which can accommodate fusing of a developed image on either side of a copy substrate without complicated inversion apparatus. There also is a need for a multiple fuser roll system which can accommodate images having varying fusing characteristics with minimal power requirements.

OBJECTS AND SUMMARY OF THE INVENTION

It is an object of the present invention to provide a three-roll fuser roll architecture which includes a driven reversible pressure roll and two fuser rolls aligned in a substantially linear fashion, allowing passage of unfused paper through either of two nips.

It is another object of the present invention to provide a three-roll fuser architecture which can accommodate images developed on either side of a paper substrate. In particular, a three-roll architecture is provided which can fuse a black image located on a first side of a substrate and can fuse a color image located on an opposite side of a substrate.

The above and other objects are achieved by providing a three-roll fuser system for use in a xerographic machine, including a driven reversible central pressure roll, a first fuser roll on one side of the central pressure roll, and a second fuser roll on an opposite side of the central pressure roll. The central pressure roll and the first fuser roll form a first fusing nip. The central pressure roll and the second fuser roll form a second fusing nip. The three rolls are preferably arranged in a substantially linear fashion.

The fuser roll system has an inlet sheet path which may be separate or common for each fuser nip provided near an entrance of the fuser roll system and an outlet sheet path provided near an exit of the fuser roll system which may be a common path or separate for each nip.

In a preferred embodiment, the first fuser roll is a heated black fuser roll and the second fuser roll is a heated color fuser roll. Each of the first and second fuser rolls are specifically designed for a certain application. For example, the black fuser roll may be semisoft, of a composition such as copper or aluminum which forms a relatively short nip with the central pressure roll and the color fuser roll may be of a smooth, soft material such as silicone rubber which forms a longer nip with the central pressure roll. Both rolls may comprise a layer of Viton or other suitable elastomeric material. Usually, the extra thickness of unfused toner on a color image, due to multiple layers of different colors, requires a higher operating temperature for this fuser than that of a black image fuser roll.

These and other objects will become apparent from a reading of the following detailed description in connection with the drawings.

BRIEF DESCRIPTION OF THE DRAWINGS

The invention will be described in detail with reference to the following drawings wherein.

DETAILED DESCRIPTION OF PREFERRED EMBODIMENTS

Figure 1:
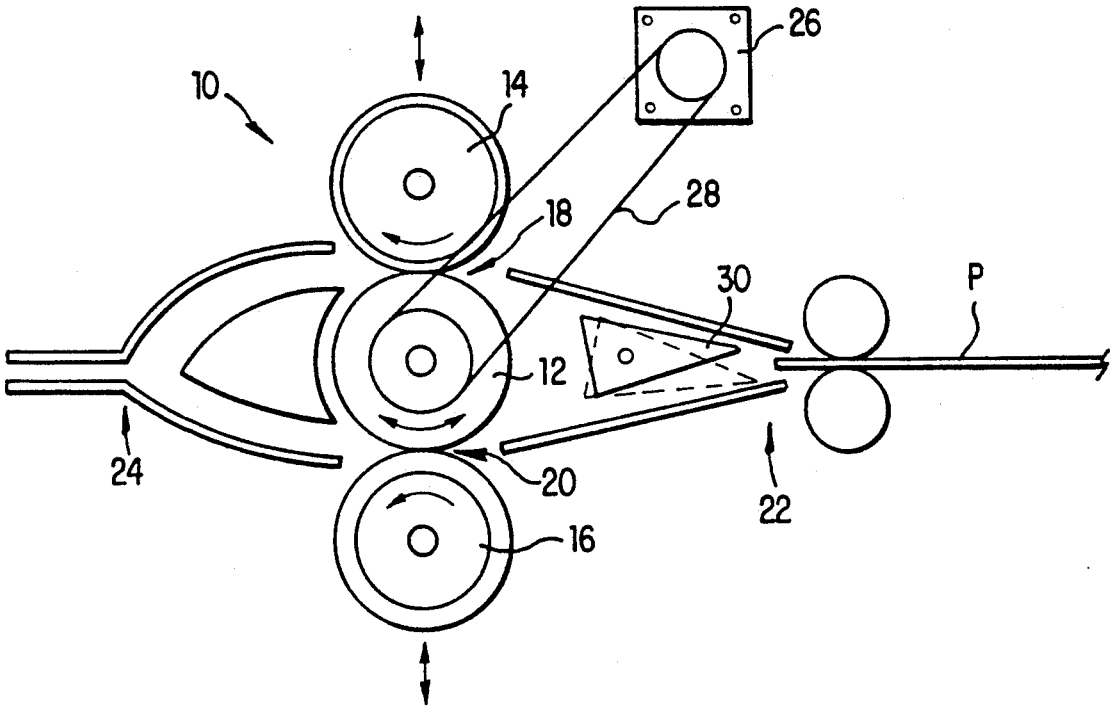
FIG. 1 is an end view of a three-roll fuser architecture according to the present invention having a common copy sheet inlet, a sheet diverting mechanism and a rejoined common copy sheet outlet.

With reference to FIG. 1, the present invention provides a three-roll fuser system 10 for use in a xerographic machine, including a driven reversible central pressure roll 12, a first fuser roll 14, and a second fuser roll 16. The central pressure roll 12 and first fuser roll 14 form a first fusing nip 18. The central pressure roll 12 and second fuser roll 16 form a second fusing nip 20. As shown, the three rolls 12, 14, and 16 are arranged in a substantially linear fashion.

In a preferred embodiment, the fuser roll system 10 has a common inlet sheet path 22 provided near an entrance of the fuser roll system 10 and a common outlet sheet path 24 provided near an exit of the fuser roll system 10 for passing a copy substrate such as a copy sheet P therethrough, although it is also contemplated that different transport paths may be provided for the copy substrate. The present invention also can be used with alternative copy substrates such as a web fed from a supply roll to a take-up roll. In such an application, a cutter mechanism may be provided to cut the web to appropriate sized sheets.

Figure 2:
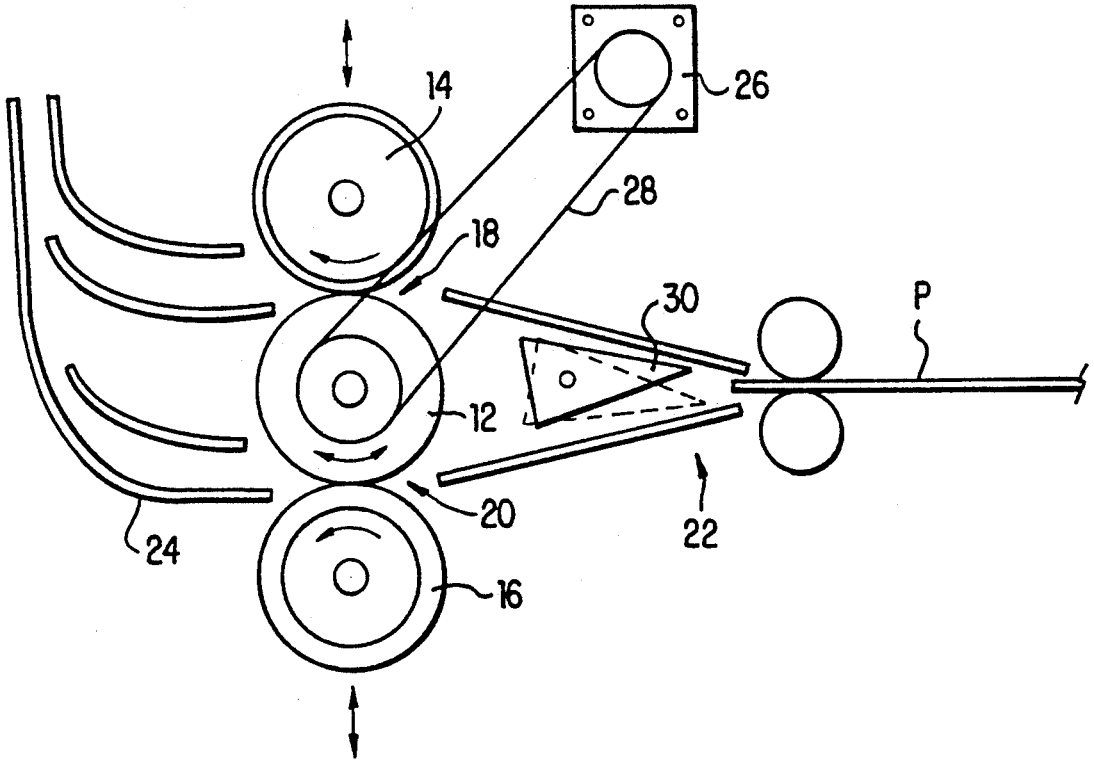
FIG. 2 is an end view of a three-roll fuser architecture similar to FIG. 1, only having separate outlet paths provided.
Figure 3:
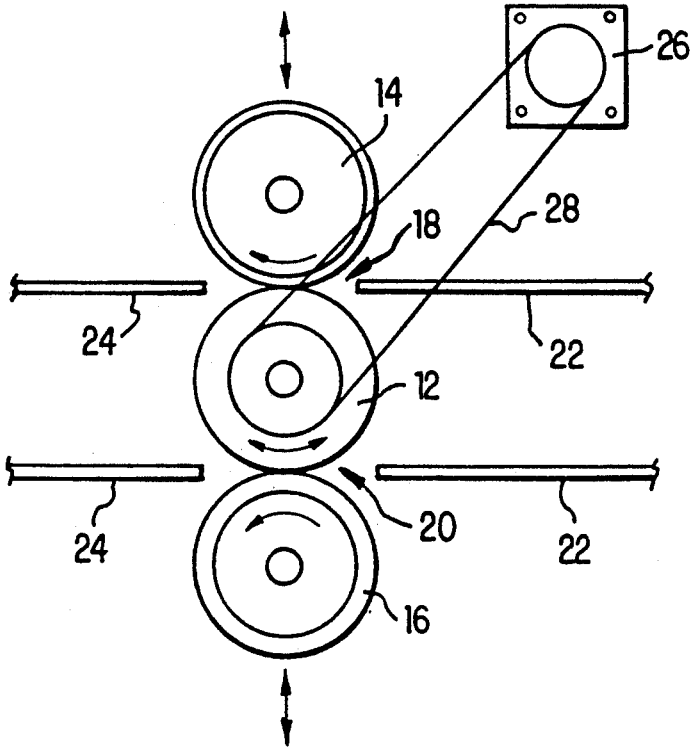
FIG. 3 is an end view of a three-roll fuser architecture having separate inlet and outlet paths for a first and second fuser nip.

In the above embodiment, developed unfused black images can enter the fuser on a separate inlet sheet path from developed unfused color images (FIG. 3) or each nip may be provided with a separate outlet path (FIG. 2).

In a most preferred embodiment, fuser roll 14 is a heated black fuser roll and fuser roll 16 is a heated color fuser roll. Each of fuser rolls 14 and 16 are specifically designed for a certain application. For example, black fuser roll 14 may be semisoft, of a composition such as a copper or aluminum which forms a relatively short nip with pressure roll 12 and color fuser roll 16 may be of a smooth, soft material such as silicone rubber, although other materials may be used, which forms a longer nip with pressure roll 12. Both rolls may comprise a layer of Viton or other suitable elastomeric material. Usually, the extra thickness of unfused toner on a color image, due to multiple layers of different colors, requires a higher operating temperature for this fuser than that of a black image fuser roll.

Engagement mechanisms are provided to engage and disengage each fuser roll 14, 16 from the central pressure roll 12. Suitable mechanisms are described in U.S. Pat. No. 4,716,435, assigned to the same assignee as the present invention, and incorporated herein by reference in its entirety. For brevity, the drawings have arrows designating that first fuser roll 14 and second fuser roll 16 are movable toward and away from central pressure roll 12. For example, when first nip 18 is required, first fuser roll 14 can be movably engaged in a contacting position with an outer surface of central roll 12 to provide the first nip 18. At the same time, second fuser roll 16 is moved away from or remains spaced a predetermined distance from central roll 12. The reverse would occur if the second nip 20 is required to fuse toner on a copy sheet.

A drive mechanism is provided to enable rotation of the central pressure roll in either direction, at an appropriate speed. A suitable drive mechanism consists of a drive motor 26 which is connected to central roll 12 by a drive belt or drive chain 28. The drive chain or belt 28 mates with appropriate pulleys or sprockets located on drive motor 26 and central roll 12. A suitable drive system for a roll is shown in U.S. Pat. No. 4,967,237 to Sasaki et al., incorporated herein by reference in its entirety. In a simplest form, the drive motor 26 can drive pressure roll 12 at a same predetermined speed in either direction. Alternatively, suitable controls may be provided for controllably adjusting the rotational speed of the central pressure roll 12. This may be desirable since it allows a different speed to be used for transporting a copy sheet through a fuser nip. For example, it may be beneficial to have the pressure roll 12 driven at one speed when driving a first fuser nip to provide optimum fusing, and having the pressure roll 12 driven at another speed when driving a second fuser nip to provide optimum fusing. This changes the total fusing time through which the copy sheet is in contact with the appropriate fusing nip.

The fuser rolls 14 and 16 as shown in the drawings are driven by frictional contact with central pressure roll 12, although they may alternatively have their own drive mechanism which operates to rotate each fuser roll in a predetermined direction complementary with the direction of rotation of the central pressure roll to positively feed a copy sheet through the selected fuser nip. The rotational speed of the separately driven fuser roll 14 or 16 is chosen so as to provide a substantially same linear speed to a copy sheet through the nip as the linear speed provided by the driven pressure roll 12. A slight mismatch in relative speed between rolls 14, 16 and central roll 12 may be beneficial to provide a slippage between one of the rolls and the copy sheet to minimize paper rucking.

Diverters 30 such as baffles and/or vacuum transports may be provided in a prefusing area between the common sheet inlet and the fuser system 10 to carry unfused copies to either first fuser nip 18 or second fuser nip 20. As shown in FIG. 1, diverter 30 is a baffle which can be selectively positioned between two positions to provide a sheet path from common inlet 22 to nip 18 or nip 20. The baffle 30 can be controlled through appropriate controls or signals known in the art. For example, in a preferred embodiment, a copier is provided which produces black copies on a top side of a copy sheet in one mode and provides color copies on a bottom side of the copy sheet in another mode. Selection of the desired mode, i.e., either color or black, sends a suitable control signal to the baffle 30 such that it is positioned to guide the copy sheet to the required nip 18 or 20. Selection of a desired mode described above can also provide a control signal which controls directional rotation of central roll 12 and engagement or disengagement of fuser rolls 14 and 16 with central roll 12.

Similar baffles and/or vacuum transports can also be provided to a post-fusing area between the fuser system 10 and an output 24. This output may be to a common rejoined path such as common outlet 24 shown in FIGS. 1 and 2 or to separate output trays or paths shown in FIG. 3. There may also be a duplex return loop provided for printing on a second side of a copy sheet.

One important structural advantage of the present invention is that images can be fused on either side of a copy sheet. This is accommodated by the three roll architecture having a central reversibly-drivable pressure roll and first and second fuser rolls. As shown in the drawings, if an unfused image is developed on a top side of the copy sheet P, the image can be fused by passing the copy sheet P through first nip 18. In this example, the central roll 12 is driven counterclockwise by drive motor 26 such that a copy sheet P can be fed from inlet 22 through nip 18 and into outlet 24. Baffle 30 in FIG. 1 would be positioned in the dashed position to direct the copy sheet to first nip 18. Central roll 12 rotates heated roll 14 in a clockwise direction. As the copy sheet P passes through nip 18, an unfused image on the top side of the copy sheet contacts the heated outer surface of fuser roll 14 and is fused.

If an unfused image is located on a bottom side of the copy sheet P, the image can be fused by passing the copy sheet P through the second nip 20. In this example, the central roll 12 is driven clockwise by drive motor 26 such that a copy sheet can be fed from inlet 22 to outlet 24 through second nip 20. Baffle 30 in FIG. 1 would be in the solid line position for this example. Central roll 12 rotates heated fuser roll 16 in a counterclockwise direction. As the copy sheet passes through nip 20, an unfused image on the bottom side of the copy sheet P contacts the heated outer surface of fuser roll 16 and is fused. In the known prior art, this provision was not possible without some form of prefusing sheet inversion step such that all copy sheets were uniform in orientation, i.e., all having an unfused image on a same side of the copy sheet.

This particular arrangement can handle fusing of images which are developed by a xerographic or other developing device on either side of the copy sheet. This is highly useful if more than one development station is present in the machine. For instance, there may be one or more modes provided on a copier which allow selection of which side of a copy sheet a developed image is desired. The present invention can accommodate fusing of the copy sheet developed by the copier described above without additional sheet inverting apparatus. Alternatively, if all copy modes, i.e., such as printing in black and white or color, develop an image on a same side, one of nips 18 and 20 can be provided with a pre-nip sheet invertor which properly orients copy sheet P such that an unfused image is correctly oriented when fed through nips 18 and 20.

In a preferred embodiment, the first nip 18 provides fusing of a black and white image and the second nip 20 provides fusing of a color image.

In a particular known xerographic copier, due to the nature of the intermediate color transfer web utilized, color images are developed on a different side of a copy sheet from those formed using a black only mode. The copier is capable of providing color and black and white printing through the use of a transfer drum or belt. In such a copier, copy sheets can be fed into a transfer nip. For monochrome copies, the transfer device, either a drum or belt, functions as a large bias transfer roll and toner is directly transferred to the copy sheet. When the sheet is transported toward the fuser, the unfused side of the sheet having toner is on a photoreceptor side, i.e. on the top side of the copy sheet. Thus, the sheet can pass through black nip 18 of the fuser system 10 in a proper orientation. For color, however, the individual separations are transferred onto the belt or drum surface, acting as an intermediate transfer belt or drum. Once the three or four color image is assembled on the intermediate, its bias is reversed with respect to the photoreceptor, a copy sheet is fed into the transfer nip and the image is transferred to the copy sheet. Thus, when the copy sheet is transported to fuser system 10, it is transferred directly to the fuser with unfused toner on the intermediate side, i.e. on the bottom side of the copy sheet. Thus, the color image is oriented correctly to be fused with color fuser nip 20 according to the present invention without any additional sheet handling steps such as sheet inversion. Known fuser systems cannot accommodate this particular copier architecture without requiring inversion of either the black image or the color image due to the structural limitations of their design.

The present three-roll architecture according to the present invention naturally accommodates such an architecture while also solving the problem of compromise between fuser roll constraints by provision of two fuser rolls, each having different operating parameters and design constraints. As previously discussed, each of the fuser rolls 14 and 16 may be designed according to different criteria such as durometer hardness, heating temperature, pressure roll velocity, nip length, etc.

The invention has been described with reference to the preferred embodiments thereof, which are illustrative and not limiting. Various changes may be made without departing from the spirit and scope of the invention as defined in the appended claims.

What is claimed is:

1. A three roll fuser system for a xerographic machine, comprising:

a reversibly drivable central pressure roll;

a first fuser roll located adjacent said central pressure roll;

a first fuser nip formed between said pressure roll and said first fuser roll capable of receiving and fusing a copy substrate;

a second fuser roll located adjacent said central pressure roll on a substantially opposite side of said central pressure roll as said first fuser roll;

a second fuser nip formed between said central pressure roll and said second fuser roll capable of receiving and fusing a copy substrate;

a sheet inlet for transporting a copy substrate having a first surface and a second surface opposite the first surface, the sheet inlet transporting a copy substrate having a developed unfused image on said first surface thereof to said first nip for fusing of said first surface image by contact of said first surface image with said first fuser roll and transporting a copy substrate having a developed unfused image on said second surface thereof to said second nip for fusing of said second surface image by contact of said second surface image with said second fuser roll; and a sheet outlet for receiving copy substrates from at least one of said first and second fuser nips of the fuser system.

2. The three roll fuser system of claim 1, further including a sheet diverter which selectively diverts the copy substrate from the inlet through one of said first and second nips.

3. The three roll fuser system of claim 2, wherein the sheet diverter is a baffle.

4. The three roll fuser system of claim 2, wherein said sheet diverter is a vacuum transport.

5. The three roll fuser system of claim 1, further including a drive motor capable of driving said central pressure roll in a counterclockwise direction to positively feed the copy substrate through said first nip.

6. The three roll fuser system of claim 1, further including a drive motor capable of driving said central pressure roll in a clockwise direction to positively feed the copy substrate through said second nip.

7. The three roll fuser system of claim 1, wherein said inlet is a path common to the first and second nips.

8. The three roll fuser system of claim 1, wherein said inlet comprises two separate paper paths, one to each of said first and second nips.

9. The three roll fuser system of claim 1, where said outlet is a rejoined common outlet path.

10. The three roll fuser system of claim 1, wherein said outlet comprises a separate outlet path for each of said first and second fuser nips.

11. The three roll fuser system of claim 1, wherein said first fuser roll has different physical properties from said second fuser roll.

12. The three roll fuser system of claim 1, wherein said first fuser roll has a heater which heats said first fuser roll to a different operating temperature than an operating temperature of said second fuser roll.

13. The three roll fuser system of claim 1, wherein said reversibly driven central roll is driven by a drive motor having a variable rotational speed.

14. The three roll fuser system of claim 13, wherein said drive motor rotates at a first predetermined rotational speed when a copy substrate is transported through said first fuser nip and said drive motor rotates at a different, second predetermined rotational speed when a copy sheet is transported through said second nip.

15. The three roll fuser system of claim 1, wherein said first and second fuser rolls are driven independent from said central pressure roll.

16. The three roll fuser system of claim 1, wherein said first fuser roll, said second fuser rolls and said central pressure roll are each driven independent of one another.

17. A three roll fuser system for a xerographic machine, comprising:

a reversibly drivable central pressure roll;

a first heatable fuser roll located adjacent said central pressure roll;

a first fuser nip formed between said pressure roll and said first fuser roll capable of receiving a copy substrate and fusing an unfused image located on a first side of the copy substrate;

a second heatable fuser roll located adjacent said central pressure;

a second fuser nip formed between said central pressure roll and said second fuser roll capable of receiving a copy substrate and fusing an unfused image located on a second side of the copy substrate;

a sheet inlet for transporting copy substrates having an unfused image on one of a first side and a second side directly to a selected one of said first and second fuser nips of the fuser system based on which side of the copy substrates the unfused image is located; and a sheet outlet for receiving fused copy substrates from one of said first and second fuser nips of the fuser system.

18. The fuser system of claim 17, further comprising a drive motor for driving said central pressure roll in either of a clockwise and a counterclockwise direction to positively feed the copy substrate through a selected one of said first and second nips.

19. The fuser system of claim 17, wherein said sheet inlet includes a sheet diverter to divert the copy substrate to a selected one of said first and second nips.

20. A method of fusing unfused toner onto a copy substrate using a three roll fuser system having a reversibly drivable central pressure roll and first and second fuser rolls, the first and second fuser rolls being positionable immediately adjacent to the central pressure roll and on substantially opposite sides of the central pressure roll to form first and second fuser nips, comprising the steps of:

selectively transporting a copy substrate having an unfused image on a side thereof to one of said first and second fuser nips based on whether the unfused image is located on a top side or a bottom side of the copy substrate; and driving the central pressure roll in one of a clockwise and a counterclockwise rotational direction to provide feeding of the copy substrate through the selected one of said first and second fuser nips in a positive feed direction to fuse said image onto said copy substrate.

21. The method of claim 20, wherein said first and second fuser rolls are each positionable in contact with and spaced from a surface of said central pressure roll.

22. The method of claim 21, wherein only one of said first and second fuser rolls is in contact with said central pressure roll during said driving step.

23. The method of claim 20, wherein said selectively transporting step includes diverting the copy substrate from a common inlet path to a selected one of said first and second fuser nips.

24. The method of claim 20, wherein each of said first and second fuser rolls are selectively heatable.

25. The method of claim 24, wherein only the fuser roll forming the selected fuser nip with said central pressure roll is heated.

26. The method of claim 20, wherein at least one of said first and second fuser rolls is selectively positioned between a fusing position wherein said at least one fuser roll is in contact with said central pressure roll and a spaced position wherein said at least one fuser roll is spaced away from and not in contact with said central pressure roll.

27. A method of fusing unfused toner onto a copy substrate using a three roll fuser system having a reversibly drivable central pressure roll and first and second fuser rolls, said first and second fuser rolls being positionable immediately adjacent to the central pressure roll and on substantially opposite sides of said central pressure roll to form first and second fuser nips, comprising the steps of:

transporting a copy substrate having an unfused image on a side thereof to a common fuser inlet;

diverting the copy substrate to said first fuser nip when the unfused image is on a top side of the copy substrate;

diverting the copy substrate to said second fuser nip when the unfused image is on a bottom side of the copy substrate;

driving said central pressure roll in a direction which positively feeds the copy substrate through said fuser system to fuse the image on the copy substrate.

28. The method of claim 27, further comprising the step of heating at least one of said first and second fuser rolls.

* * * * *